US007365270B2

(12) United States Patent
Michaud et al.

(10) Patent No.: US 7,365,270 B2
(45) Date of Patent: Apr. 29, 2008

(54) TWIST-ON CONNECTOR

(75) Inventors: Alain Michaud, St. Jean-Richelieu (CA); Viorel Popovici, Pointe Claire (CA); Pierre Fortin, St. Hubert (CA)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/244,820

(22) Filed: Oct. 6, 2005

(65) Prior Publication Data

US 2006/0070765 A1 Apr. 6, 2006

Related U.S. Application Data

(60) Provisional application No. 60/616,382, filed on Oct. 6, 2004.

(51) Int. Cl.
*H01R 4/00* (2006.01)

(52) U.S. Cl. ..... 174/87

(58) Field of Classification Search ..... 174/87; D13/150

See application file for complete search history.

(56) References Cited

U.S. PATENT DOCUMENTS

| | | | | | |
|---|---|---|---|---|---|
| 2,870,239 | A | | 1/1959 | Ustin | |
| 3,016,774 | A | | 1/1962 | Minobe | |
| 3,132,202 | A | | 5/1964 | Wolf | |
| 3,308,229 | A | | 3/1967 | Burniston | |
| 3,347,979 | A | * | 10/1967 | Hoffman | 174/87 |
| 3,350,499 | A | | 10/1967 | Swanson | |
| 3,519,707 | A | | 7/1970 | Krup | |
| 3,787,948 | A | | 1/1974 | Runge | |
| D233,891 | S | | 12/1974 | Aldighieri | |
| 4,227,040 | A | | 10/1980 | Scott | |
| 4,288,657 | A | * | 9/1981 | Swanson | 174/87 |
| 4,350,841 | A | | 9/1982 | Scott | |
| 4,823,650 | A | | 4/1989 | Tuttle | |
| 4,883,921 | A | * | 11/1989 | Legerius et al. | 174/87 |
| 4,924,035 | A | | 5/1990 | Miller et al. | |
| D315,143 | S | * | 3/1991 | Blaha | D13/150 |
| 5,001,301 | A | | 3/1991 | Marr et al. | |
| 5,023,401 | A | * | 6/1991 | Clifton | 174/87 |
| 5,132,494 | A | * | 7/1992 | Burton et al. | 174/87 |
| D330,011 | S | | 10/1992 | Miller et al. | |
| D339,106 | S | | 9/1993 | McLaughlin et al. | |
| 5,260,515 | A | | 11/1993 | Braun, Jr. | |
| D345,962 | S | | 4/1994 | Clifton et al. | |
| D366,866 | S | | 2/1996 | Whitehead et al. | |
| 5,557,069 | A | | 9/1996 | Whitehead et al. | |

(Continued)

FOREIGN PATENT DOCUMENTS

| | | |
|---|---|---|
| CA | 1294681 | 1/1992 |

(Continued)

*Primary Examiner*—Chau N. Nguyen
(74) *Attorney, Agent, or Firm*—Hoffman & Baron, LLP

(57) ABSTRACT

A twist-on wire connector including an elongate insulated housing having a closed upper end, an open lower end and a central cavity. The housing includes a pair of diametrically opposed outwardly directed elongate continuous wings. The wings extend from the open end along the longitudinal portion of the housing. The wings have two sections with different dimensions to accommodate manual attachment or attachment by use of a tool such as a socket for applying the connector to the conductors.

9 Claims, 8 Drawing Sheets

U.S. PATENT DOCUMENTS

| | | | | |
|---|---|---|---|---|
| 5,557,070 | A | | 9/1996 | Tamm |
| 5,559,307 | A | | 9/1996 | Whitehead et al. |
| D379,348 | S | | 5/1997 | Korinek |
| 5,784,935 | A | | 7/1998 | Korinek |
| 5,832,796 | A | | 11/1998 | Chopra |
| D402,629 | S | | 12/1998 | Benedict |
| D404,714 | S | * | 1/1999 | Axelsson ..... D13/150 |
| 5,894,110 | A | | 4/1999 | Simmons et al. |
| 5,910,643 | A | | 6/1999 | Laine et al. |
| D415,470 | S | | 10/1999 | Pedrinelli |
| 6,198,049 | B1 | | 3/2001 | Korinek |
| 6,252,170 | B1 | | 6/2001 | Korinek |
| 6,414,243 | B1 | | 7/2002 | Korinek et al. |
| 6,478,606 | B1 | | 11/2002 | McNerney et al. |
| 6,570,094 | B2 | | 5/2003 | King, Jr. |
| D480,283 | S | | 10/2003 | Brown |
| 6,677,530 | B2 | | 1/2004 | Blaha et al. |
| D502,923 | S | * | 3/2005 | Thompson et al. ..... D13/150 |

FOREIGN PATENT DOCUMENTS

| | | | |
|---|---|---|---|
| CA | 1301876 | | 5/1992 |
| CA | 2152735 | A1 | 12/1995 |
| CA | 2152736 | | 12/1995 |
| CA | 2264711 | | 4/1998 |
| CA | 2097139 | | 8/1998 |
| CA | 2346783 | | 2/2001 |
| CA | 2030693 | | 4/2004 |

* cited by examiner

TWIST-ON CONNECTOR

CROSS-REFERENCE TO RELATED APPLICATIONS

This application claims priority to U.S. Provisional Application No. 60/616,382, filed Oct. 6, 2004.

FIELD OF THE INVENTION

The present invention relates generally to a twist-on wire connector used to terminate electrical wires. More particularly, the present invention relates to a twist-on wire connector which may be applied to electrical wires either manually or with the use of a standard socket type tool.

BACKGROUND OF THE INVENTION

A well known and common practice is to connect electrical wires using a twist-on or screw-on wire connector. These connectors are used to connect the stripped ends of two or more insulated or non-insulated conductors. Typically, these twist-on wire connectors include a plastic insulated shell and a wire spring supported therein. The wire spring may be conical in shape so that when the connector is placed over the stripped ends of the insulated electrical conductors and twisted thereon, the conductors are brought into electrical engagement with each other within the spring. Secure mechanical and electrical engagement between the twist-on connector and the electrical wires relies on the correct application of the connector to the wires.

Improvements have been made in twist-on electrical connectors to permit the easy and secure termination of the wires. One technique, which is well known, is to use diametrically opposed outwardly directed wings which fit between the thumb and forefinger of the installer to provide a degree of leverage to permit the twisting of the connector onto the conductors.

U.S. Pat. No. 4,227,040 is one example of a twist-on wire connector employing such wings.

In certain instances, depending upon the type of wires which are connected and also for speed installation, it is desirable to use a tool to twist the wire connector onto the ends of the conductors.

U.S. Pat. No. 6,198,049 discloses a twist-on wire connector having a pair of outwardly extending wings that project radially from the connector body which provides a finger grip surface for installing the connector on the conductor. The upper end of the connector body is modified to accommodate a specially designed tool which may be used to twist the connector on to the conductors.

Similarly, U.S. Pat. No. 6,252,170 provides a twist-on wire connector having wings extending from the lower end and a modified upper end which accommodates a tool which may apply torque to the connector to terminate the connector to the electrical conductors. The design of the '170 patent provides a torque limiting feature such that the upper end is distorted upon excessive torque by the tool.

While each of these devices serves adequately for its intended purpose, none provide a simple construction which allows for both manual attachment of the connector to the conductors as well as attachment by use of a standard tool such as a socket or the like.

SUMMARY OF THE INVENTION

The present invention provides a twist-on wire connector. The connector includes an elongate insulated housing having a closed upper end, an open lower end and a central cavity in communication with the open end for accommodating a conductive spring. The housing includes a pair of diametrically opposed outwardly directed elongate continuous wings. The wings extend from the open end along the longitudinal portion of the housing. Each of the wings includes a first wing section adjacent to the open end having a first dimension which is used for manually attaching the connector to the conductor. The second wing section extends from the first wing section towards the closed end of the housing. The second wing section has a second extending dimension which is less than the first extending dimension and may be accommodated by a tool such as a socket for applying the connector to the conductors.

DETAILED DESCRIPTION OF THE PREFERRED EMBODIMENTS

Figure 1:
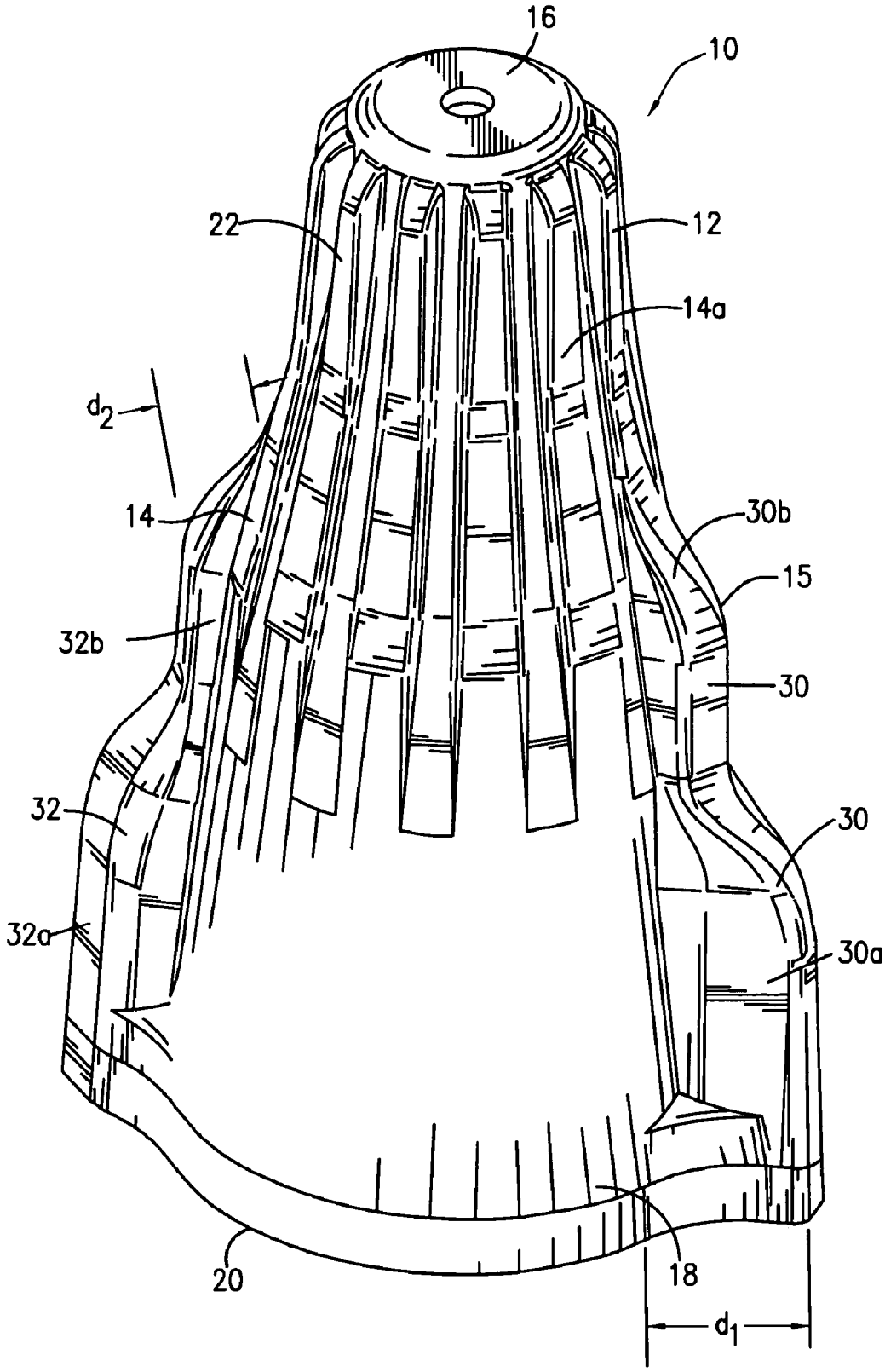
FIG. 1 is a perspective showing of the wire connector of the present invention.
Figure 2:
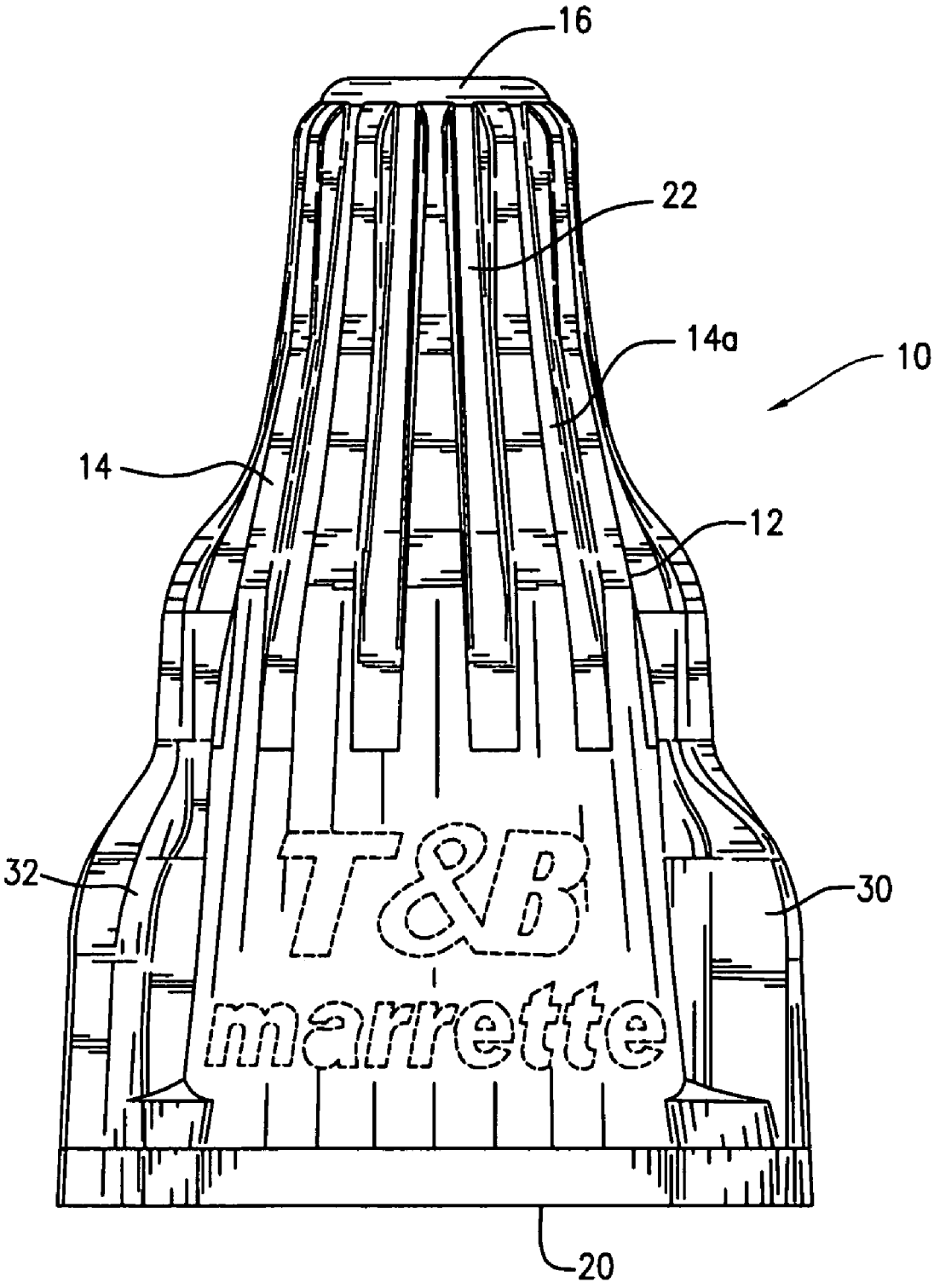
FIGS. 2 through 5 are elevational showings of the front, right side, back and left side of the wire connector of FIG. 1.
Figure 3:
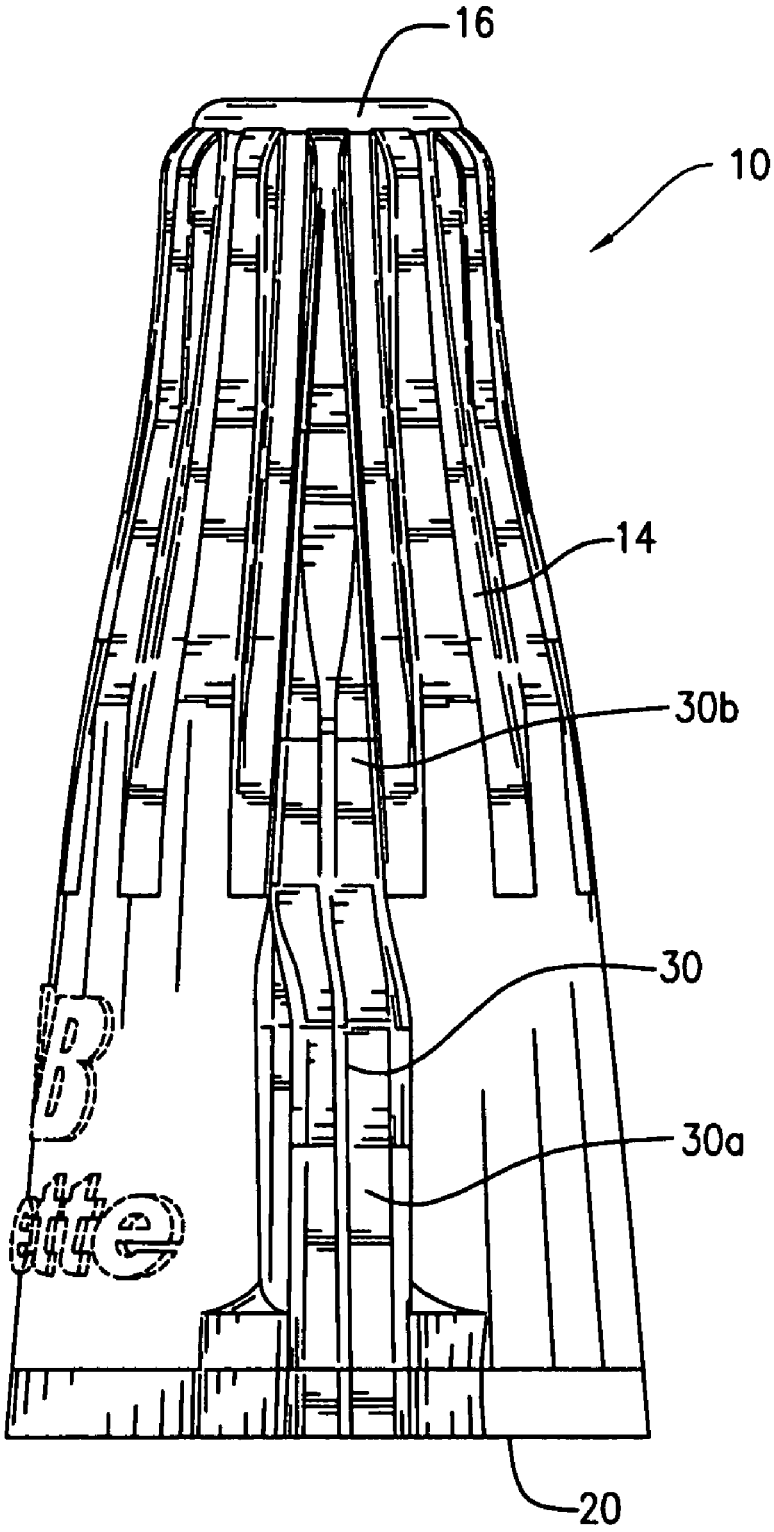
Figure 4:
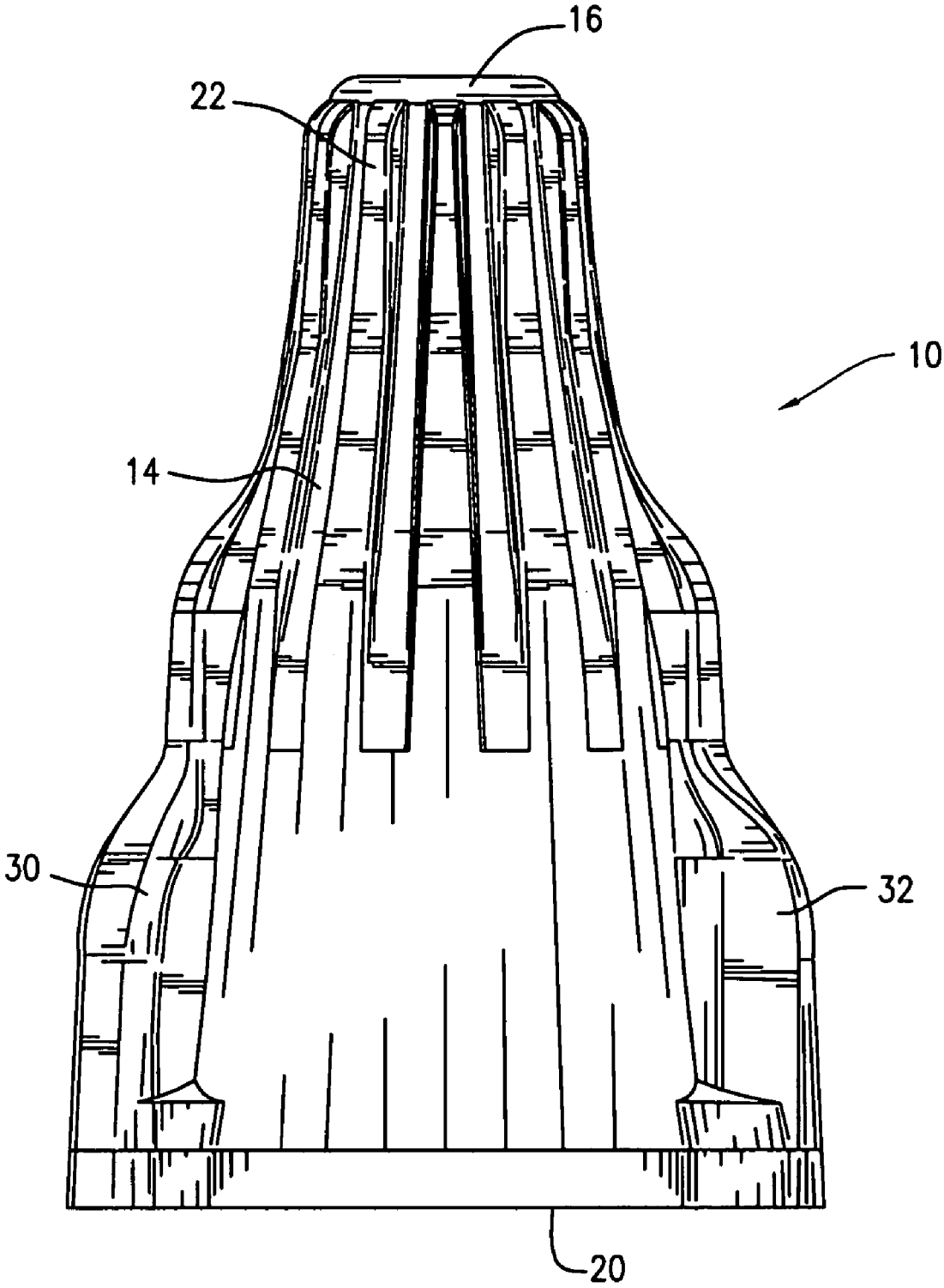
Figure 5:
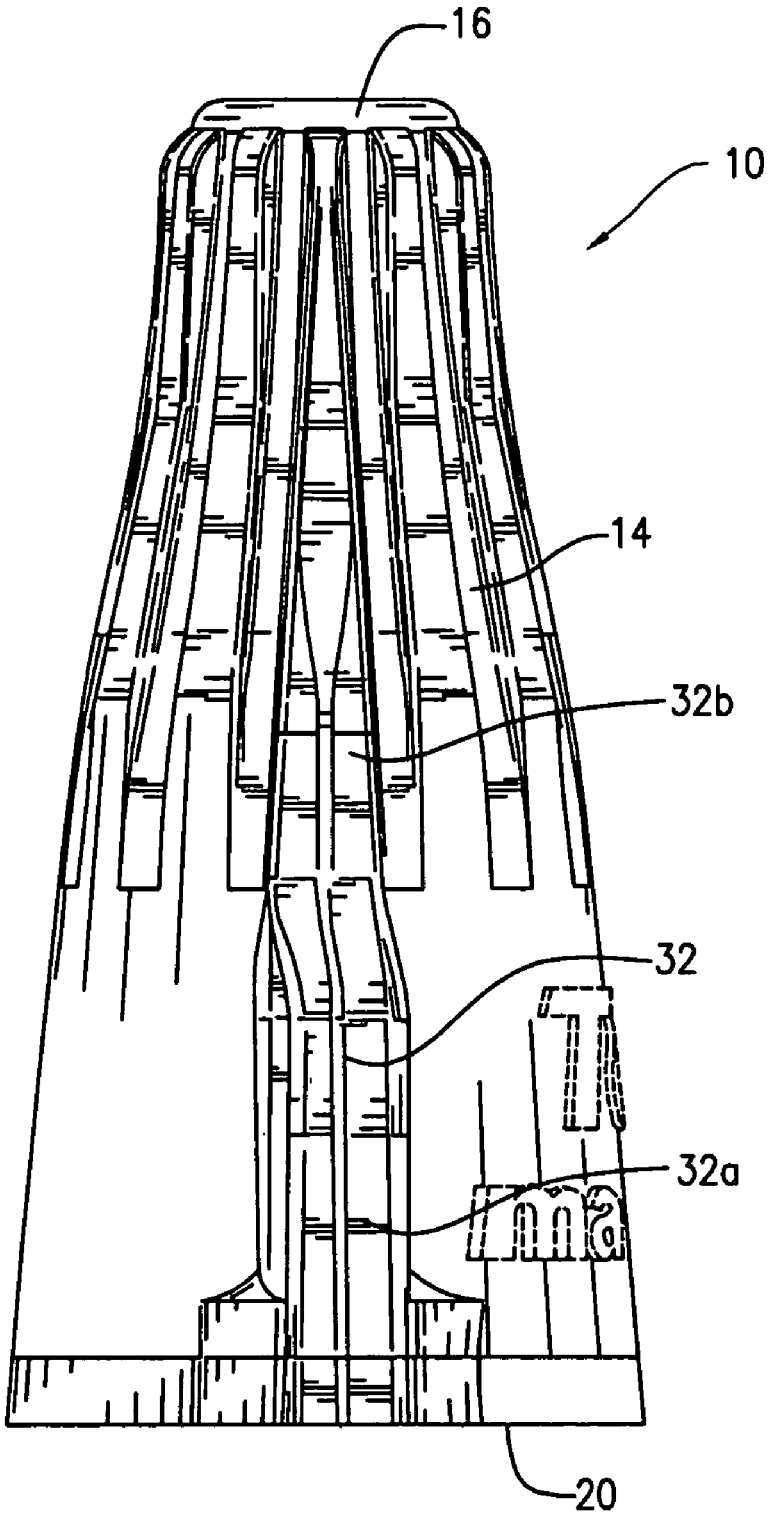
Figure 6:
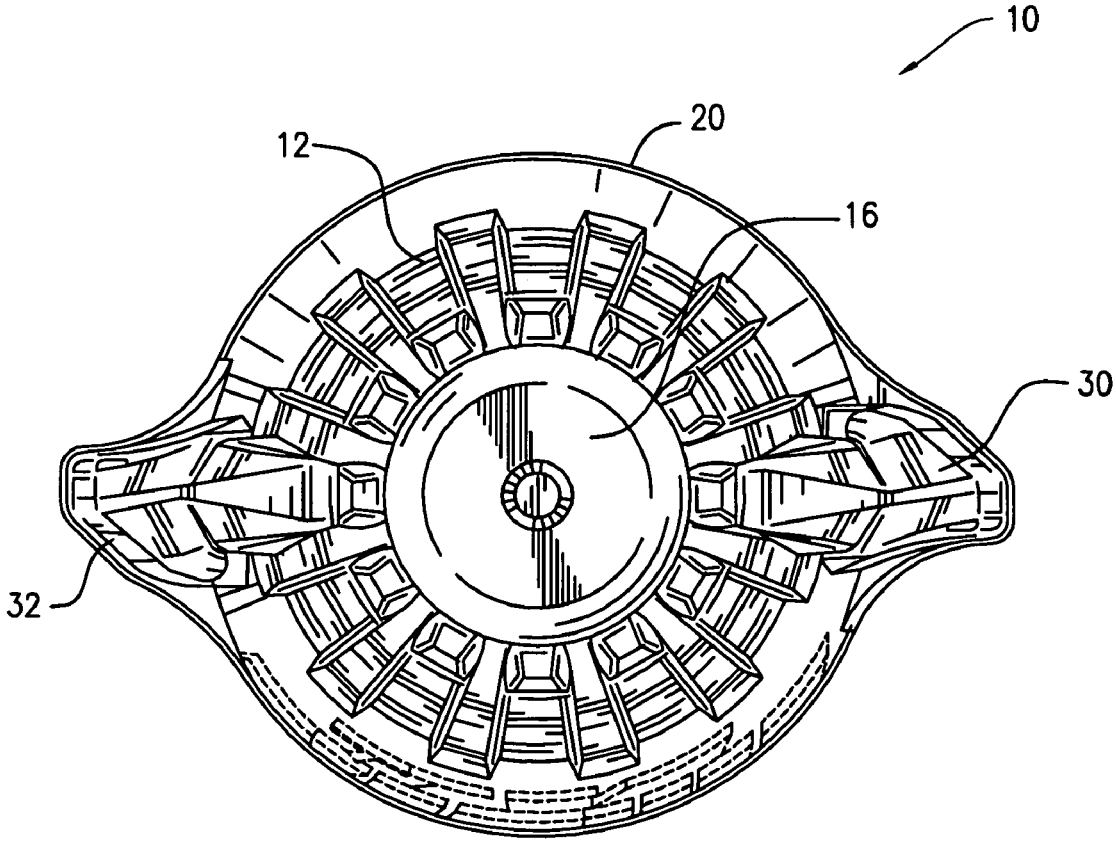
FIGS. 6 and 7 are top and bottom elevational showings of the wire connector of FIG. 1.

Referring to FIGS. 1 through 7 of the present invention, a twist-on wire connector 10 of the present invention is shown. Twist-on wire connector 10 is typically a two-piece embodiment including an elongate insulative housing 12 and a conical wire spring (not shown) supported by the housing. As is well-known in the twist-on connector art, the connector 10 may be used to connect two or more insulated or stripped electrical wires together by applying the housing over the ends of the wires. One example of such a conventional twist-on wire connector employing a connector housing and a metallic conical spring is shown in commonly assigned U.S. Pat. No. 5,559,307, the disclosure of which is incorporated by reference herein.

Housing 12 is an elongate member formed of a suitably insulated molded thermoplastic material. Housing 12 includes a generally frustroconically shaped upper portion 14 tapering towards a closed end 16. A wider lower skirt portion 18 which is nearly cylindrical in shape includes an open end 20 opposed to closed end 16.

Figure 7:
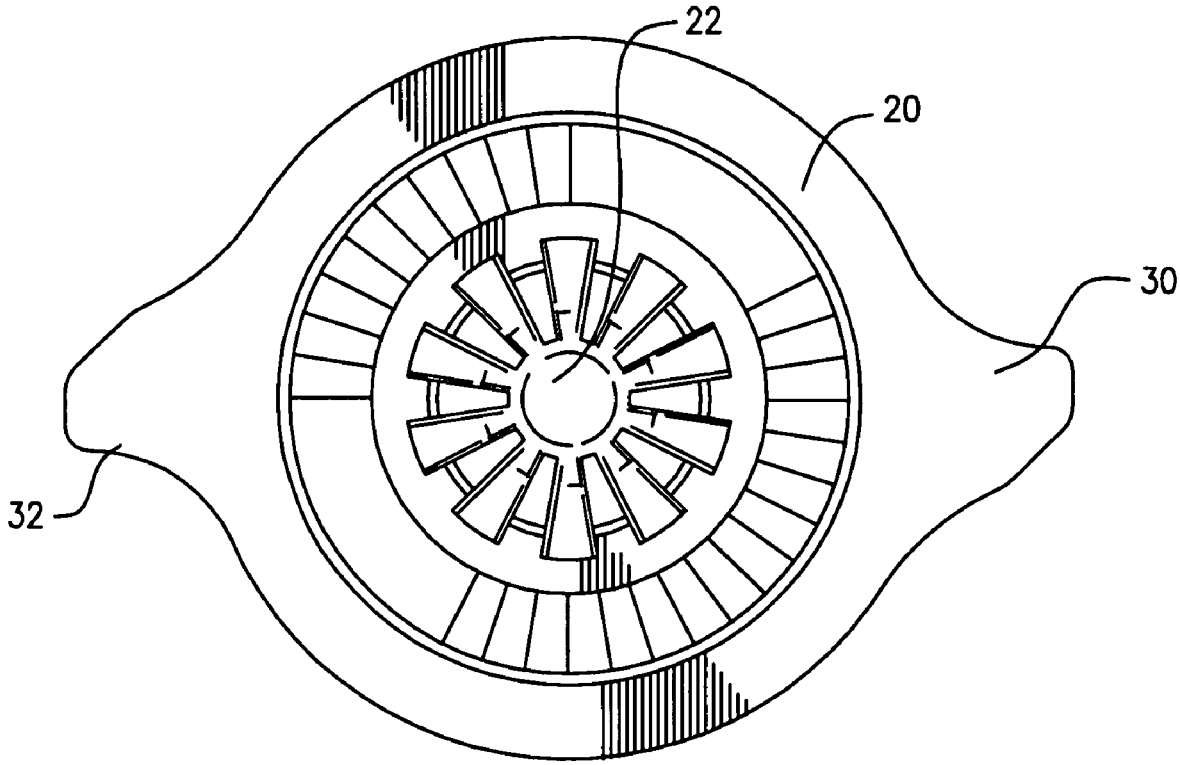

As shown in FIG. 7, the open end 20 defines a central cavity 22 in which the conical spring (not shown) is positioned in conventional fashion.

The outer wall 14*a* of upper portion 14 may include a plurality of elongate ribs 22 which assist in manual gripping and turning of the connector 10 about electrical wires as is well known.

The outer wall 15 of housing 12 further includes a pair of elongate diametrically opposed wings 30 and 32. Wings 30 and 32 extend radially outwardly from wall 15. The wings extend from open end 20 along the outer wall 15 of housing 12 towards closed end 16.

Each of wings 30 and 32 includes two continuous but distinct wing sections. Wing sections 30*a* and 32*a* extend from open end 20 each having a radially outward first dimension $d_1$. Second wing sections 30*b* and 32*b* extend from first wing section towards the closed end 16 of housing 12. The second wing sections 30*b* and 32*b* extend a radial distance $d_2$ which is less than the distance $d_1$ of the first wing sections 30*a* and 32*a*.

Each of wings sections 30*a*, 32*a*, 30*b*, and 32*b* are selected to provide optimum attachment of the wire connector 10 to the wires which are to be connected. The wider first wing sections 30*a* and 32*a* are positioned and arranged so that wire connector 10 can be manually turned onto the wires. The wider wing sections permit the thumb and forefinger of the installer to easily apply the necessary rotational forces to turn the wire connector onto the wires.

The second wing sections 30*b* and 32*b* are selected so that a connectional socket may be placed over the upper end 16 of connector housing 12, such that the second wing sections fit within the convolutions or recesses of the socket. Thus the connector 10 of the present invention may by applied to wires by use of a socket attached to a nut driver or similar tool.

The present invention defines two distinct wing sections for two types of application of the connector to the wires. First wing sections near the open end of the connector allow for manual attachment, while the second wing sections, which are intermediate and closer to the closed end allow for installation over the wires by use of a socket type tool.

Figure 8:
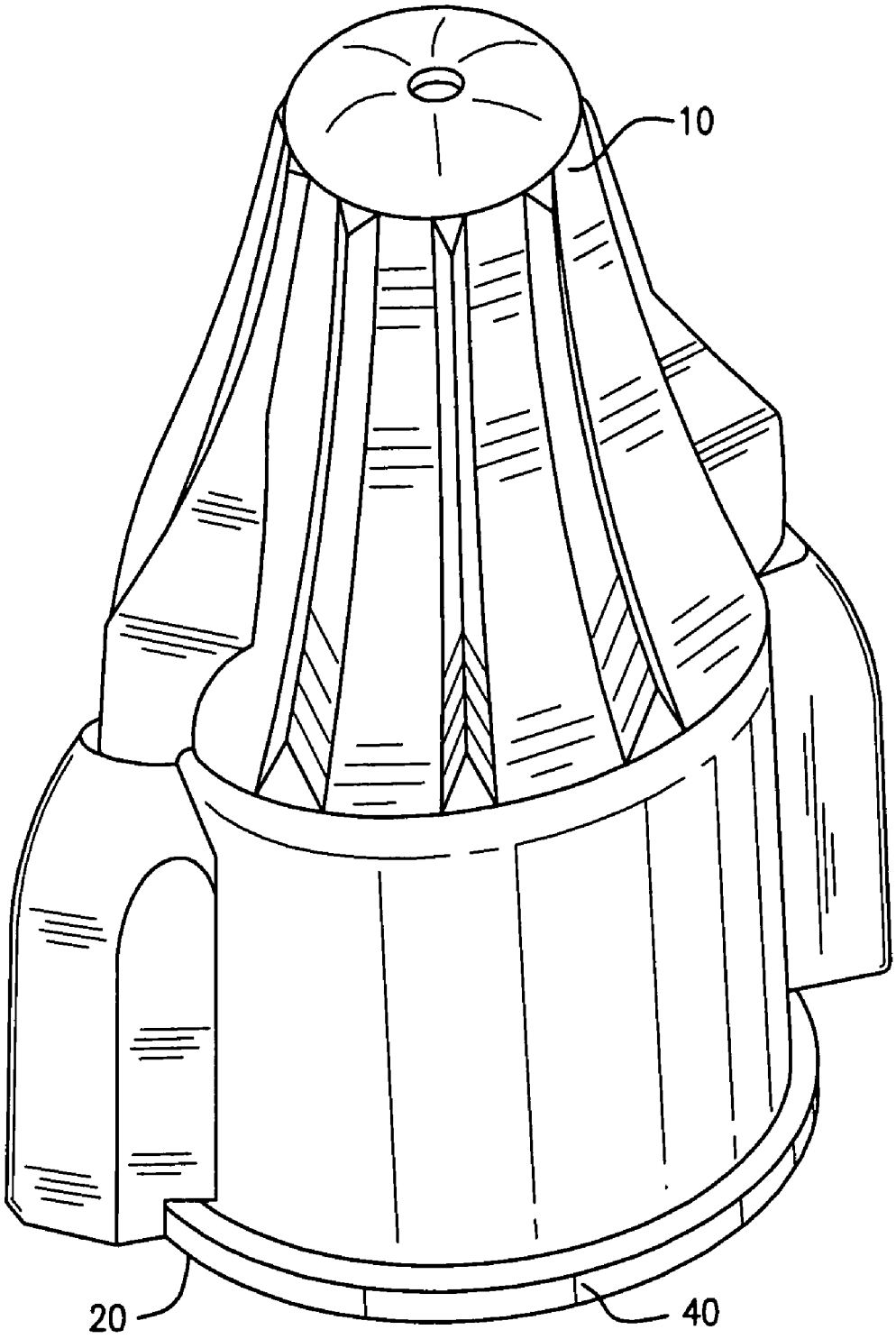
FIG. 8 shows an alternate embodiment of the wire connector of the present invention.

Referring now to FIG. 8, a further embodiment of the present invention, the connector 10 includes at the open lower end 20 an outwardly directed ledge 40 circumferentially thereabout. The ledge 40 functions as a stop surface so that when the connector is manually placed on the wires, a downward action can be applied without the fingers of the installer slipping off the connector.

What is claimed is:

1. A twist-on wire connector comprising:

an elongate insulated housing having a closed upper end, an open lower end and a central cavity in communication with said open end for accommodating a conductive spring; and a pair of diametrically opposed outwardly directed elongate continuous wings extending from said open end along a longitudinal portion of said housing, each of said elongate wings having a first wing section adjacent said open end and extending radially outward from said insulated housing defining a first dimension and a second wing section extending from said first wing section towards said closed end and extending radially outward from said insulating housing defining a second dimension, said second dimension is less than said first dimension, said second wing section having a longitudinal portion extending parallel to a central longitudinal axis of said housing.

2. A twist-on wire connector claim 1 wherein said housing includes an outwardly extending ledge at least partially about said open end.

3. A twist-on wire connector of claim 1 wherein said first wing section has a longitudinal portion thereof extending parallel to a central longitudinal axis of said housing.

4. A twist-on wire connector of claim 3 wherein said second wing section defines a diametrical distance as measured between said longitudinal portions from each of said second wing section which is accommodated within a standard nut socket.

5. A twist-on wire connector of claim 1 wherein said housing includes a plurality of elongated ribs.

6. A twist-on wire connector comprising:

an elongate insulated housing having a closed upper end, an open lower end and a central cavity in communication with said open end for accommodating a conductive spring;

said housing including a pair of diametrically opposed outwardly directed elongate continuous wings extending from said open end along a longitudinal portion of said housing, each of said elongate wings having a first wing section adjacent said open end and extending radially outward from said insulated housing defining a first dimension and a second wing section extending from said first wing section towards said closed end and extending radially outward from said insulating housing defining a second dimension, said second dimension is less than said first dimension, said second wing section having a longitudinal portion extending parallel to a central longitudinal axis of said housing, said housing includes an outwardly extending ledge at least partially about said open end.

7. A twist-on wire connector of claim 6 wherein said first wing section has a longitudinal portion thereof extending parallel to a central longitudinal axis of said housing.

8. A twist-on wire connector of claim 7 wherein said second wing section defines a diametrical distance as measured between said longitudinal portion from each of said second wing section which is accommodated within a standard nut socket.

9. A twist-on wire connector of claim 8 wherein said housing includes a plurality of elongated ribs.

* * * * *